US005568712A

United States Patent [19]

Jenkins et al.

[11] Patent Number: 5,568,712

[45] Date of Patent: Oct. 29, 1996

[54] REFRIGERATOR DOOR CONSTRUCTION

[75] Inventors: Thomas E. Jenkins; Duane Jubenville, both of Louisville, Ky.

[73] Assignee: General Electric Company, Louisville, Ky.

[21] Appl. No.: 407,861

[22] Filed: Mar. 21, 1995

[51] Int. Cl.[6] ..... E04C 2/08; E04C 2/30; A47B 96/04

[52] U.S. Cl. ..... 52/782.1; 52/784.13; 52/658; 49/501; 312/405

[58] Field of Search ..... 52/784.13, 658, 52/782.1; 49/501, 506; 312/405; 29/453

[56] References Cited

U.S. PATENT DOCUMENTS

| | | | |
|---|---|---|---|
| 1,848,715 | 3/1932 | Hart et al. | 29/453 |
| 4,238,908 | 12/1980 | Bunce | 49/501 |
| 4,327,535 | 5/1982 | Governale | 49/501 X |
| 4,896,458 | 1/1990 | McKann et al. | 49/506 X |
| 5,369,901 | 12/1994 | Revlett | 49/501 X |

*Primary Examiner*—Christopher T. Kent
*Attorney, Agent, or Firm*—H. Neil Houser

[57] ABSTRACT

A refrigerator door is formed of a unitary sheet of pre-painted metal. The door has a front wall with top, bottom and side walls projecting from its edges. The top and bottom walls have indented portions adjacent each of their ends. The ends of the side walls have inwardly projecting tabs which overlap the indented portions of the top and bottom walls. The tabs and indented portions are secured together by mechanical interlocks, such as toggle locks.

9 Claims, 3 Drawing Sheets

Fig. 4
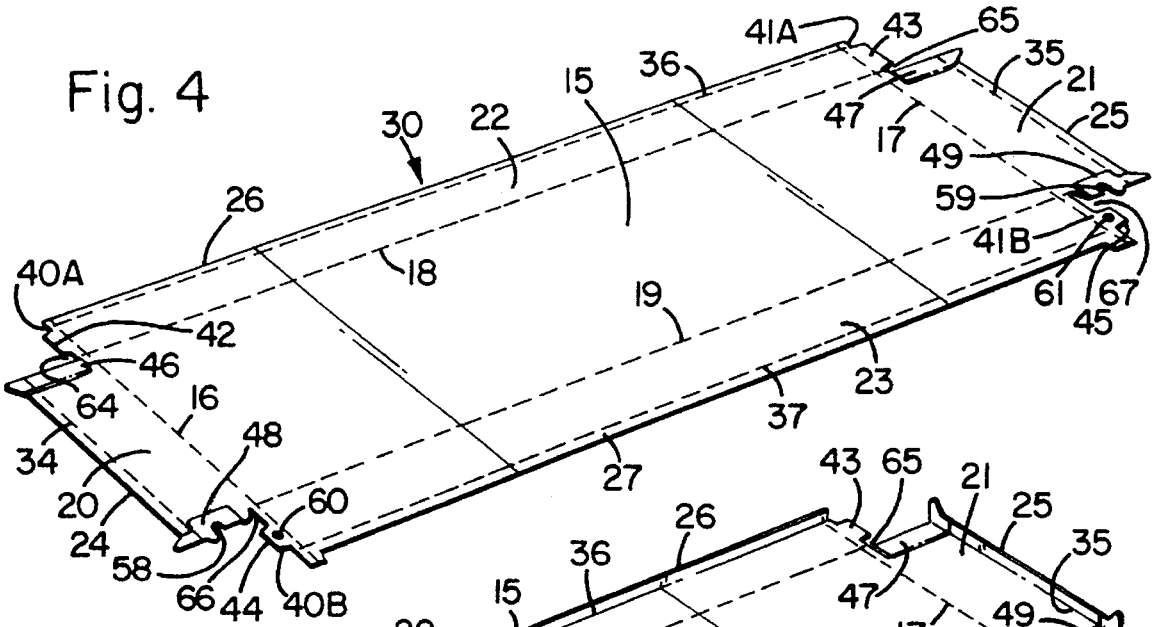
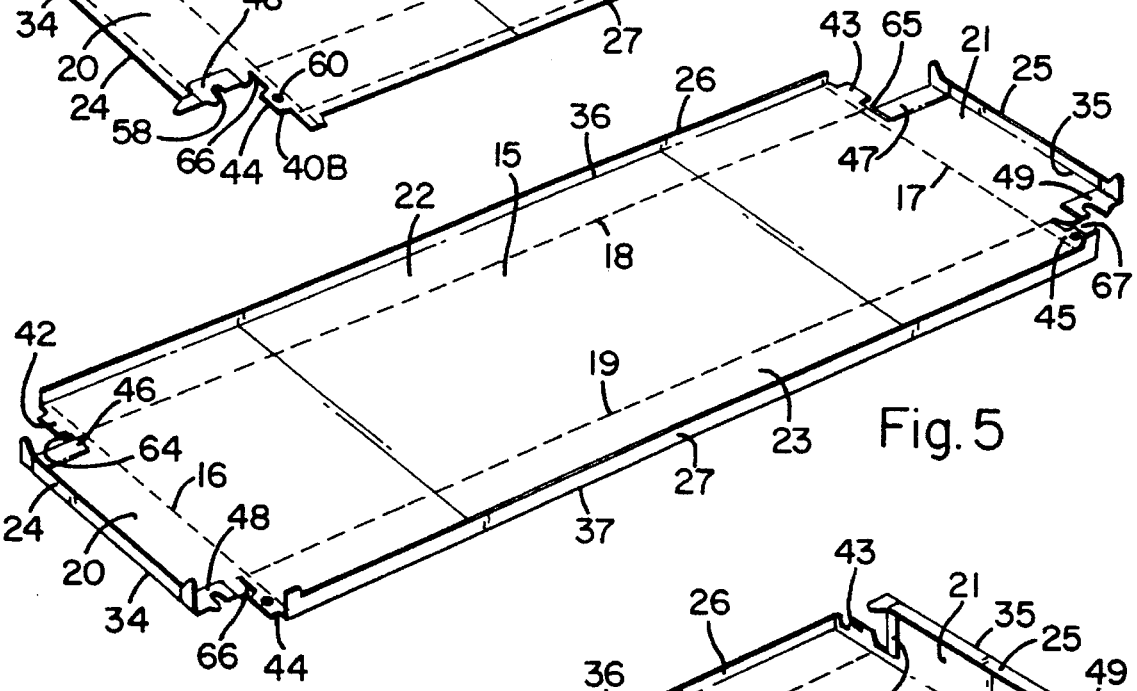
Fig. 5
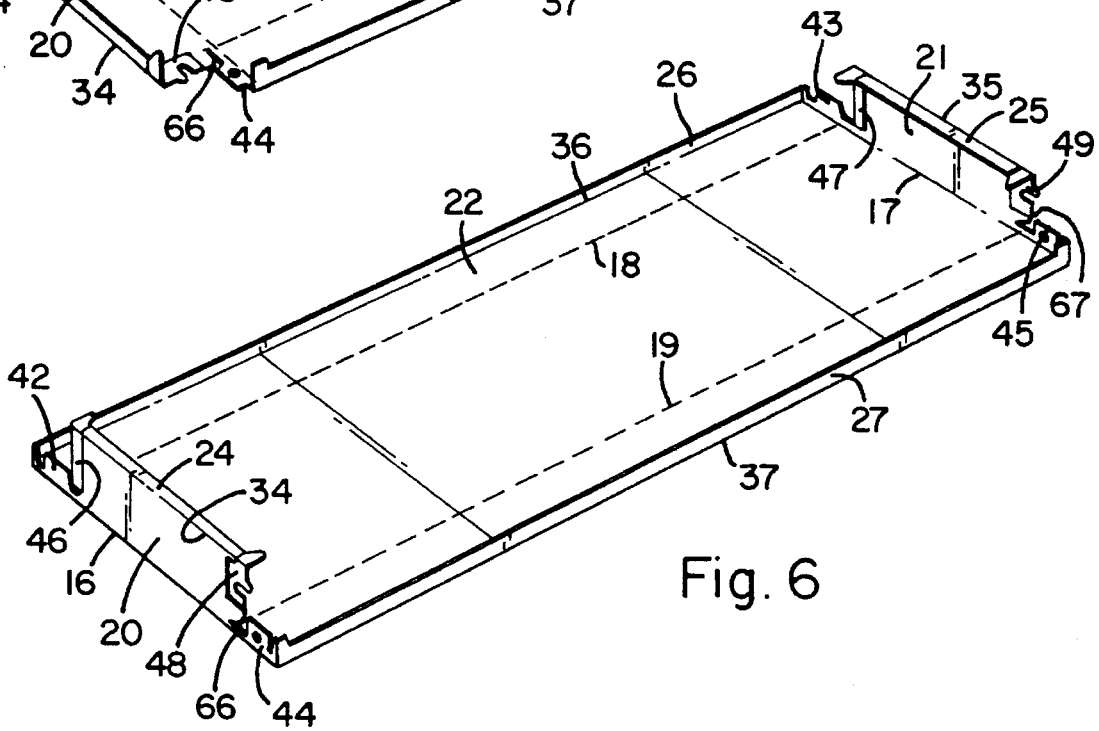
Fig. 6

REFRIGERATOR DOOR CONSTRUCTION

BACKGROUND OF THE INVENTION

This invention relates to doors for use in household refrigerators, and particularly to such doors that are formed of a sheet of a pre-coated metal, such as pre-painted steel for example. For many years refrigerator doors have been formed from sheets of steel which are bent into the desired box like configuration; with front, top, bottom and side walls and an open back. The corners between the top and bottom walls, on the one hand, and the side walls, on the other hand are welded together to form closed corner constructions. The welds are unsightly and rough and must be ground to a smooth surface before the door is painted. This is a messy and time consuming process. More recently some refrigerator doors have been formed of sheets of pre-painted steel. If a pre-painted sheet is welded, the paint in the area around the weld is ruined. After the sheet is folded to form the front, top, bottom and side walls; the corners between the top and bottom walls, on the one hand, and the side walls, on the other hand, are closed with fillers, such as plastic corner pieces. Such doors do not have as much strength and rigidity as welded doors. This is a particular disadvantage in large doors or in deep doors, in which numerous items and large items can be stored in shelves or containers on the inside of the door.

SUMMARY OF THE INVENTION

It is an object of the present invention to provide in improved refrigerator door with end portions of the side walls overlapping end portions of the top and bottom walls without wrinkling of the sheet material.

It is another object of this invention to provide an improved refrigerator door in which the walls meeting at a corner are joined by mechanical interlocks.

It is still another object of this invention to provide such a refrigerator door that is constructed of pre-coated metal.

In accordance with one embodiment of the present invention there is provided a refrigerator door constructed of a unitary sheet of pre-coated metal. The door includes a generally planar front wall having at least first and second perpendicularly disposed, intersecting edges. First and second lateral walls extend rearward from the edges and include adjacent ends. The second lateral wall forms a rounded corner with the front wall and has a flange projecting perpendicularly from its end and forming a junction with the first lateral wall adjacent the front wall. The junction defines an arcuate cutout aligned with the rounded corner. The cutout extends into the first lateral wall no further than a position substantially aligned with the adjacent portion of the rounded corner. The first lateral wall has a recessed portion adjacent its end and the second lateral wall has a tab projecting from its adjacent end and overlapping the recessed portion. A mechanical interlock arrangement connects the recessed portion and tab.

BRIEF DESCRIPTION OF THE DRAWINGS

FIG. 4 is a perspective view of the sheet of metal from which the door of FIGS. 1–2 is formed, after the corner areas of the sheet have been removed.

FIG. 5 is a perspective view of the sheet of FIG. 4 after a first bending step has been performed.

FIG. 6 is a perspective view of the sheet of FIG. 4 after a second bending operation has been performed.

DETAILED DESCRIPTION OF PREFERRED EMBODIMENT

Figure 1:
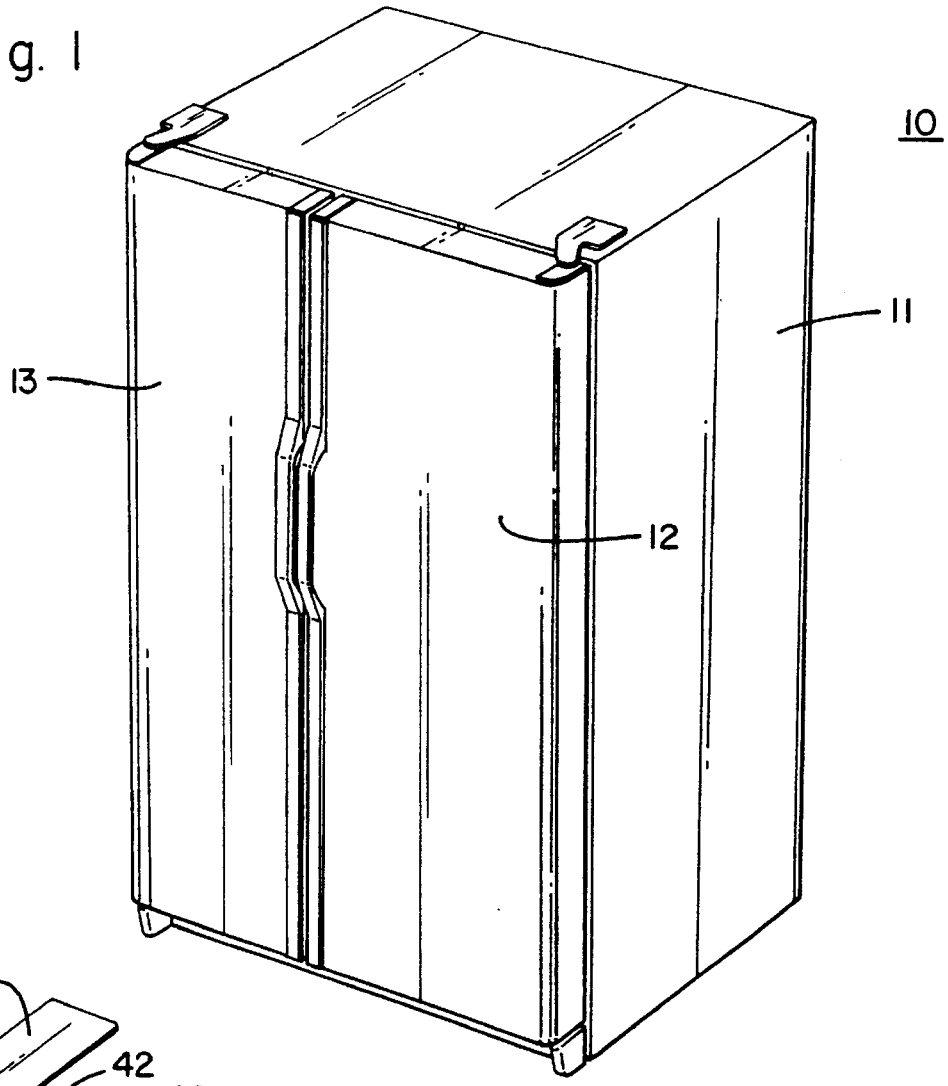
FIG. 1 is a perspective view of a side-by-side household refrigerator incorporating one embodiment of the present invention.

Referring particularly to FIG. 1, there is illustrated a household refrigerator 10 of the side-by-side type; that is, the cabinet 11 includes a fresh food compartment and freezer compartment in a side-by-side configuration. Each of the compartments has a front access opening (not shown) normally closed by a fresh food door 12 and a freezer door 13, respectively. The particular refrigerator configuration of FIG. 1 is shown for illustration purposes only and it will be understood that the present invention also is applicable to other types of refrigerators such as, for example, top mount refrigerators in which the freezer is positioned above the fresh food compartment. In addition, various operating components of refrigerators, such as the refrigeration system for example, are not involved with the present invention and have been omitted for the sake of simplicity.

Present day refrigerator doors, such as those shown at 12,13, include an outer member and an inner liner with a body of insulation positioned there between. The present invention is directed to the construction of the outer member. For the sake of simplicity the outer member is referred to as the "door" and the inner liner and insulation have been omitted, as they do not form part of the present invention.

Figure 2:
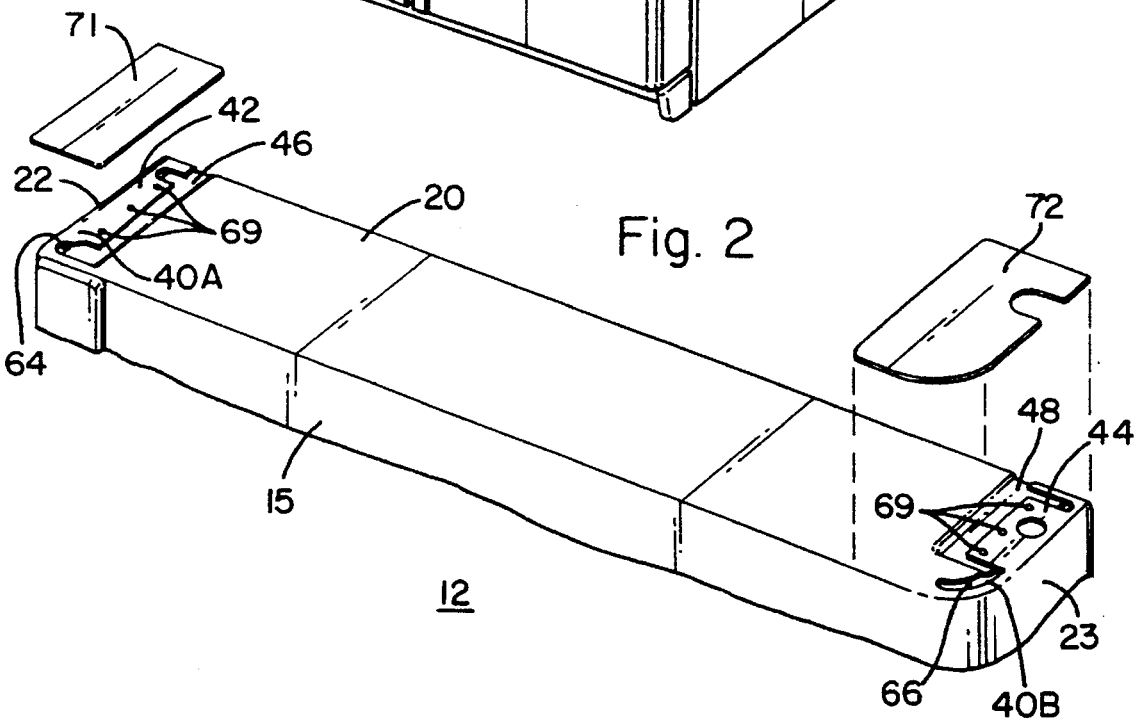
FIG. 2 is a fragmentary perspective view of the right hand door of the refrigerator of FIG. 1, with some parts removed and with the cover plates displaced for purposes of illustration.
Figure 3:
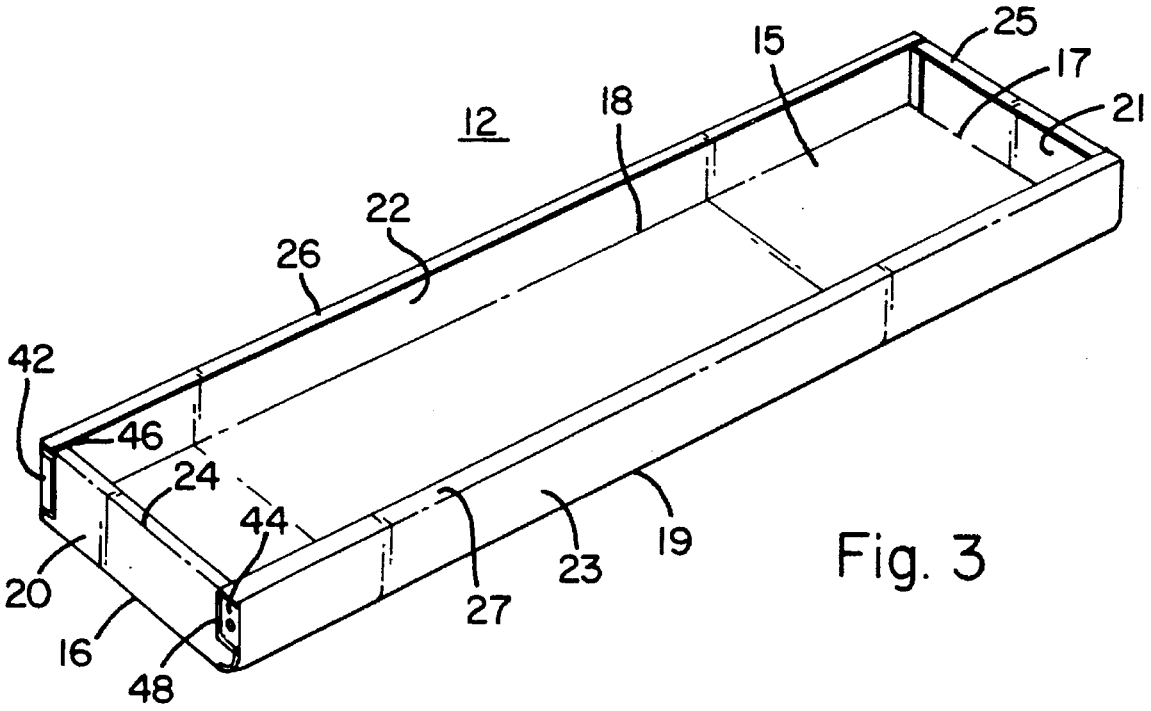
FIG. 3 is a perspective view of a sheet of metal after it has been folded to form the door of FIGS. 1 and 2.

Referring now to FIG. 3, the illustrative door 12 includes a generally rectangular front wall 15 with spaced apart top and bottom edges 16,17 joined by perpendicularly extending, spaced apart side edges 18,19. Lateral walls extend along the edges of the front wall and project to the rear, when the door is mounted on a cabinet 11. More particularly top wall 20, bottom wall 21, side wall 22 and side wall 23 project from the top, bottom, and side edges 16–19 respectively. It will be seen from FIGS. 2 and 3 that the junctions between the front wall 15 and each of the top wall 20, bottom wall 21 and side wall 22, along edges 16, 17 and 18 respectively form sharp right angles or square corners. As they preferably are formed by bending the sheet of metal from which the door is formed, they each have a very small radius but appear to be, and commonly are referred to as, "square" corners. On the other hand the junction between front wall 15 and side wall 23, along edge 19, has a smooth curve with a much larger radius. Flanges 24,25,26 and 27 project inward along the distal edges of the lateral walls 20–23 respectively and overlie the front wall 15. It will be understood that a body of insulation normally is positioned in the space defined by the walls 15 and 20–23 and that an inner liner normally is mounted on the flanges 24–27. As previously stated, the insulation and inner liner have been omitted for the sake of simplicity.

Referring now particularly to FIGS. 4–6 it will be seen that the illustrative door 12 is formed from a sheet 30 of suitable material. In particular the illustrative door 12 preferably is formed from a sheet of a suitable metal, such as a thin sheet of steel, that has been pre-painted or otherwise pre-coated with a protective coating of the desired color. As will become apparent hereafter, the present invention also is applicable to doors made from a sheet of metal that is painted after the door is formed but has its greatest advantage in doors formed from sheets of pre-coated metal, such as pre-painted steel. FIGS. 4–6 show sheet 30 in various stages of forming the door 12, with the locations of various bends indicated by dashed lines. Each section of the sheet is referred to with the same number as the corresponding component or portion of the completed door.

FIG. 4 shows the sheet 30 with the corners removed to define the front wall 15, top wall 20, bottom wall 21 and side walls 22,23, joined along edges or bend lines 16–19 respectively. The flanges 24–27 are defined by bend lines 34–37 respectively.

The side wall 22 is formed with flanges 40A and 41A at its ends while side wall 23 is formed with flanges 40B and 41B at its ends. The flanges 40A and 40B project outwardly of the side walls along the bend line 16 while the flanges 40B and 41B extend outwardly along bend line 17. The flanges 40A and 41A include tabs 42 and 43 respectively which project outwardly of the side wall 22 further than the remainder of those flanges. Similarly, the flanges 40B and 41B include tabs 44 and 45 respectively which project outwardly of side wall 23 further than the remainder of those flanges.

The ends of top wall 20 and bottom wall 21 adjacent side wall 22 are provided with recessed or indented areas or portions 46,47 respectively, which are depressed below the remainder of the walls 20,21 a distance substantially equal to the thickness of the sheet 30 and are sized to receive the flanges 40A,41A, including the tabs 42,43. As will be seen subsequently. When the door is completely formed, the flanges and tabs overlie the top and bottom walls and are received in the recessed portions and lie in a common plane with the main portion of the top and bottom walls respectively.

The ends of top wall 20 and bottom wall 21 adjacent side wall 23 are formed with recessed or indented areas or portions 48,49 respectively which are depressed below the remainder of the walls 20,21 a distance substantially equal to the thickness of the sheet 30. When the door is completely formed, the flanges 40B,41B and tabs 44,45 overlie the top and bottom walls and are received in the recessed portions 48,49 and lie in a common plane with the main portion of the top and bottom walls respectively. The recessed portions 48,49 have cutouts 58,59 respectively and the tabs 44,45 have mating holes 60,61 respectively. When the door is completely formed the cutouts and holes form openings to receive hinge pins, not shown, for mounting the door on the cabinet 11.

One aspect of the present invention is that the junctions of the top and bottom walls with the side walls is free of any significant wrinkles in the sheet 30 that would require the sheet to be smoothed and to be repainted, if it had been pre-painted. To this end the corners of the sheet where the front wall meets the top wall and each side wall; as well as where the front wall meets the bottom wall and each side wall are formed as cutouts which provide for such smooth junctions. Since the bend along edge or fold line 18 is a sharp right angle, the corners 64,65 at the ends of bend or fold line 18 are smoothly curved indentations. On the other hand, the bend between the front wall 15 and side wall 23 has a rather large radius. To this end the corners 66,67 respectively at the ends of bend line 19 are formed as elongated, smoothly curved cutouts which are somewhat arcuate in configuration. The inner ends of the cutouts 66,67 terminate substantially no further into the sheet 30 than the bend line 19, which marks the edge of the planar surface of the front wall. Stated another way, the ends of cutouts 66,67 adjacent the top and bottom walls terminate generally in alignment with the adjacent end of the bend between the front and side walls.

FIG. 5 shows the door after the next step of the formation process. Specifically the flanges 24–27 have been bent upwardly, as seen in FIG. 5, along bend lines 34–37 respectively.

FIG. 6 shows the door after the next step of the formation process. Specifically, the top wall 20 and bottom wall 21 have been bent upward, as seen in FIG. 6, along bend lines 16,17 respectively.

FIG. 3 shows the door 12 after the last bending operation has been accomplished. That is, side wall 22 has been bent upwardly along bend line 18 and side wall 23 has been bent upwardly over a relatively large radius beginning at bend line 19. The tabs 42–45 overlie the adjacent ends of the top and bottom walls 20,21 and are received in recessed portions 46–49 respectively. The flanges 40A,40B and the tabs 42,44 lie in the same plane as the main portion of top wall 20, between the recessed portions 46,48.

FIG. 2 shows the remaining components of the door 12 and illustrate the final assembly steps. The tabs 42,44 are connected to the recessed portions 46,48 of top wall 20 by mechanical interlocks 69. In the exemplification door 12 the interlocks are "toggle locks" in which mating areas of the tabs 42,44 and top wall 20 have been embossed with nesting indentations which lock the tabs 42,44 of side walls 22,23 to top wall 20 with closed corners, that is the side walls and top wall overlap. While not shown for the sake of simplicity, it will be understood that the tabs 43,45 at the bottom of side walls 22,23 overlap bottom wall 21 and are received in the recessed areas 47,49 respectively. The tabs 43,45 are connected or joined to the bottom wall 21 by suitable mechanical interlocks, such as toggle locks. Other forms of mechanical interlocks are know and can be used to join the lateral walls 20–23. For example, a "lance and lock" approach, in which mating tongues are lanced from the tabs and adjacent top and bottom walls and pushed into the door in a close interfitting relationship, can be used.

The ends of top wall 20, particularly the recessed areas 46,48 and overlying tabs 42,44 respectively are covered with appearance cover plates 71,72 respectively. In the illustrative door 12 the plates rest on the flanges 40A and 40B and on the top wall 20, inwardly of the recessed areas 46,48. The plates 71,72 can be formed from any suitable material such a a suitable plastic material such as the polycarbonate sold by General Electric Company under the trademark LEXAN which has been colored or painted to match the color of the remainder of the door. Conveniently the cover plates 71,72 are attached to the door 12 by a suitable adhesive. While not shown, it will be understood that similar plates may be used with the bottom wall 21. However, since the bottom wall 21 is not visible during use of the refrigerator, such a plate is optional.

With the construction of illustrative door 12, using a sheet 30 of pre-painted steel having a thickness of between about 0.018 inch and about 0.060 inch, we have formed doors with square corners having a radius in the range of about 0.120 inch and larger radius corners, as between front wall 15 and side wall 23, between about 0.500 inch and about 2.00 inches.

Figure 7:
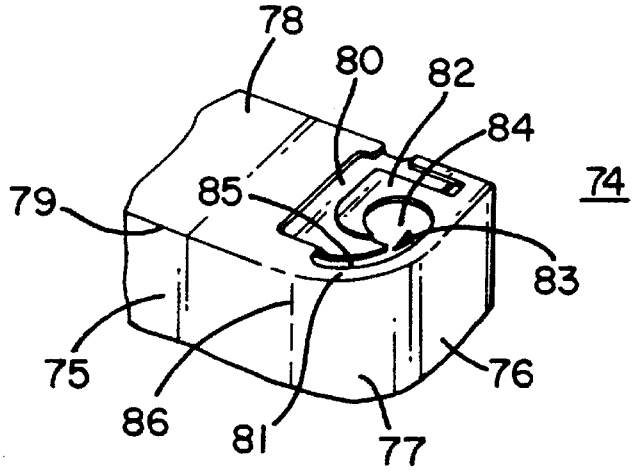
FIG. 7 is a fragmentary view of one top corner of another refrigerator door incorporating one form of the present invention.

Exemplification door 12 is representative of the type of doors currently used in a majority of household refrigerators. Such doors have a thickness, and thus the lateral walls 20–23 have a width, of up to about two inches. Some refrigerators currently are being manufactured having doors which are up to about four inches thick; often referred to as "deep doors". FIG. 7 illustrates the top corner section from such a door, which has a slightly different configuration than that shown in FIGS. 1–6. Specifically the door 74 includes a front wall 75 joined to a side wall 76 by a large radius bend 77 and to a top wall 78 by a small radius square corner or bend 79. The end of top wall 78 has a recessed portion 80. The top of side wall includes a flange 81 and tab 82, which overlies the end of top walls 78 and is received in recessed area 80. The corner between flange 81 and top wall 78 is in the form of a cutout 83. The cutout 83 is larger than the cutouts 66,67 of door 12 and is generally in the shape of a comma, with a large, round body 84 and an arcuate tail 85. The distal end of tail 85 does not extend into the top wall 78 any further than a position approximately even with the adjacent vertical edge of the planar front wall 75, as indicated by dashed line 86. With the configuration shown in FIG. 7 we have found that we can form corners or bends with a radius up to about 1.00 inch without unacceptable wrinkling of the pre-painted steel.

The present invention is particularly useful with pre-painted doors as it eliminates the need to weld the side walls to the top and bottom walls. At the same time mechanical interlock arrangements join the top and bottom walls to the side walls with closed corners, providing good strength and rigidity. It will be understood that the present invention also is useful for doors which are painted after assembly. For example no need to weld eliminates a slow and messy process and significant subsequent cleanup steps.

We have found that the various corners or bends can successively be formed using a tangent bender with end containment. For example end containment walls are positioned against the top and bottom walls 20,21 as the side wall 23 is bent with the tangent bender.

While specific embodiments of the invention have been illustrated and described herein, it is realized that modifications and changes will occur to those skilled in the art to which the invention pertains. It is therefore to be understood that the appended claims are intended to cover all such modifications and changes as fall within the true spirit and scope of the invention.

What is claimed is:

1. A refrigerator door formed of a unitary sheet of metal, including:

a generally rectangular front wall having top, bottom and side edges;

top, bottom and side walls projecting rearward from said top, bottom and side edges respectively of said front wall;

said top and bottom walls having indented end portions;

said side walls having top and bottom edges with tabs projecting laterally therefrom and overlapping respective ones of said top and bottom wall indented end portions; and mechanical interlocks connecting said overlapping end portions and tabs.

2. A refrigerator door as set forth in claim 1, further including: appearance plates covering the overlapping end portions and tabs.

3. A refrigerator door as set forth in claim 1, wherein said top and bottom edges of said side walls include laterally projecting flanges aligned with associated ones of said top and bottom walls, said tabs projecting laterally beyond the associated flanges;

each flange and the associated one of said top and bottom walls forming a junction with a curved section of said sheet removed from the junction between each flange and the associated one of said top and bottom walls.

4. A refrigerator as set forth in claim 3, wherein:

said front wall is generally planar;

said curved section at the junction between each flange and the associated top and bottom wall extends no further along the associated one of said top and bottom walls than substantially to a position adjacent the edge of said planar front wall.

5. A refrigerator door as set forth in claim 1, wherein: said sheet is a metal to which an appearance finish has been applied before formation of said door.

6. A refrigerator door formed from a unitary sheet of pre-coated metal, including:

a front wall having at least first and second perpendicularly disposed, intersecting edges;

first and second lateral walls extending rearward from said first and second edges respectively and including adjacent ends;

said second lateral wall and said front wall joined by a rounded corner;

said second lateral wall having a flange projecting perpendicularly from its end and forming a junction with said first lateral wall along said front wall at said rounded corner; and said junction between said first wall and said second wall flange defining an arcuate cutout aligned with said rounded corner, said cutout extending into said first lateral wall no further than a position substantially aligned with the adjacent portion of said rounded corner.

7. A refrigerator door as set forth in claim 6, wherein:

said first lateral wall includes a recessed portion adjacent its end;

said second wall has a tab projecting from its end beyond said flange and overlying said recessed portion of said first lateral wall;

whereby said flange and tab lie in substantially a common plane with the part of said first lateral wall adjacent said recessed portion.

8. A refrigerator door as set forth in claim 7, further including: at least one mechanical interlock connecting said overlapping recessed portion and tab.

9. A refrigerator as set forth in claim 7, further including: an appearance plate positioned over said tab and recessed portion.

* * * * *